US011120763B1

(12) United States Patent
Tao

(10) Patent No.: US 11,120,763 B1
(45) Date of Patent: Sep. 14, 2021

(54) DISPLAY PANEL, GATE DRIVING METHOD AND DISPLAY DEVICE

(71) Applicant: WUHAN CHINA STAR OPTOELECTRONICS TECHNOLOGY CO., LTD., Hubei (CN)

(72) Inventor: Jian Tao, Hubei (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 0 days.

(21) Appl. No.: 17/041,077

(22) PCT Filed: Jul. 23, 2020

(86) PCT No.: PCT/CN2020/103793

§ 371 (c)(1),
(2) Date: Sep. 24, 2020

(30) Foreign Application Priority Data

Jun. 19, 2020 (CN) ..... 202010566758.7

(51) Int. Cl.
*G09G 3/36* (2006.01)

(52) U.S. Cl.
CPC ..... *G09G 3/3677* (2013.01); *G09G 3/3696* (2013.01); *G09G 2300/0426* (2013.01); *G09G 2310/0243* (2013.01)

(58) Field of Classification Search
CPC ..... G09G 3/3677; G09G 3/3696; G09G 2300/0426; G09G 2300/0243
See application file for complete search history.

(56) References Cited

U.S. PATENT DOCUMENTS

| | | | | |
|---|---|---|---|---|
| 9,378,700 | B2 * | 6/2016 | Lai | G09G 3/3611 |
| 10,170,031 | B2 * | 1/2019 | Li | G09G 3/2092 |
| 2002/0084968 | A1 | 7/2002 | Park et al. | |
| 2005/0105319 | A1 * | 5/2005 | Baek | G09G 3/3648 365/87 |
| 2007/0279360 | A1 * | 12/2007 | Park | G09G 3/3696 345/94 |
| 2008/0001894 | A1 * | 1/2008 | Oh | G09G 3/3677 345/98 |
| 2015/0206488 | A1 | 7/2015 | Zhang et al. | |

(Continued)

FOREIGN PATENT DOCUMENTS

| | | | |
|---|---|---|---|
| CN | 103778896 | A | 5/2014 |
| CN | 104036726 | A | 9/2014 |

(Continued)

*Primary Examiner* — Sejoon Ahn
(74) *Attorney, Agent, or Firm* — Mark M. Friedman

(57) ABSTRACT

A display pane, a gate driving method and a display device are provided. The display panel comprises a pixel driving circuit in a display area and a gate driving circuit in a non-display area. The gate driving circuit is electrically connected to a first voltage end and a second voltage end. The first voltage end is configured to turn off a driving transistor of the pixel driving circuit electrically connected to an output end of the gate driving circuit. The second voltage end is configured to turn off an output transistor of the gate driving circuit to suppress the gate voltage shift of the driving transistor in the pixel driving circuit such that the reliability of the driving transistor and the fault tolerance of the display panel could be raised.

11 Claims, 6 Drawing Sheets

(56) References Cited

U.S. PATENT DOCUMENTS

| | | | | |
|---|---|---|---|---|
| 2015/0243203 | A1* | 8/2015 | Kim | H01L 27/1225 345/212 |
| 2016/0253953 | A1 | 9/2016 | Yang et al. | |
| 2016/0314850 | A1* | 10/2016 | Gu | G11C 19/28 |
| 2018/0296490 | A1 | 10/2018 | Sun et al. | |

FOREIGN PATENT DOCUMENTS

| | | | |
|---|---|---|---|
| CN | 106847160 | A | 6/2017 |
| CN | 108630167 | A | 10/2018 |

* cited by examiner

DISPLAY PANEL, GATE DRIVING METHOD AND DISPLAY DEVICE

FIELD OF THE INVENTION

The present invention relates to a display technique, and more particularly, to a display panel, a gate driving method, and a display device.

BACKGROUND

Using the Low Temperature Polycrystalline Oxide (LTPO) back plate could have the advantages of Low Temperature Polysilicon (LTPS) and oxide techniques. The LTPO display device could accomplish high/low frequency switching and achieve the purposes of low power consumption and high display quality. However, the LTPS and the oxide have different electric characteristics. When the oxide transistors are biased or in a high temperature for a long time, the threshold voltage may shift. In order to suppress this, the gate voltage needs to be adjusted. However, adjusting the gate voltage will influence the electric characteristics of the LTPS transistors and this will ruin the operation of the display device.

SUMMARY

Technical Problem

One objective of an embodiment of the present invention is to provide a display panel, a gate driving method, and a display device, capable of suppressing the threshold voltage shift of the driving transistor in the pixel driving circuit and raising the reliability of the driving transistor and fault tolerance of the display panel.

Technical Solution

According to an embodiment of the present invention, a display panel is disclosed. The display panel comprises a pixel driving circuit in a display area and a gate driving circuit in a non-display area. The gate driving circuit is electrically connected to a first voltage end and a second voltage end. The first voltage end is configured to turn off a driving transistor of the pixel driving circuit electrically connected to an output end of the gate driving circuit. The second voltage end is configured to turn off an output transistor of the gate driving circuit.

In the display panel, the gate driving circuit comprises: cascaded stages of sub-circuits, wherein an $n^{th}$-stage sub-circuit of the sub-circuits comprises: a scan control module, configured to perform a forward scan or a backward scan according to a scan control signal; and a pull-down control module, electrically connected to the scan control module, configured to control a working state of a pull-down module according to the scan control module. The pull-down module is electrically connected to the pull-down control module and an output module, the pull-down module is electrically connected to the first voltage end and the second voltage end; the pull-down module is configured to, in a reset state, utilize the second voltage end to turn off the output transistor of the output module and connect the first voltage end to an output end of the output module to pull down the output end of the output module such that the driving transistor of the pixel driving circuit is turned off. The output module is electrically connected to the scan control module and the pull-down module; the output module receives an $n^{th}$-stage clock signal; and the output module is configured to output a gate driving signal.

In the display panel, the pull-down module comprises: a pull-down transistor, having a gate electrically connected to the pull-down control module, a first electrode electrically connected to the output module, and a second electrode receiving the second voltage end, the pull-down transistor configured to turn off the output transistor in the reset state to stop writing the $n^{th}$-stage clock signal into the output end of the output module; a reset transistor, having a gate electrically connected to the gate of the pull-down transistor, a first electrode electrically connected to the output end of the output module, and a second electrode electrically connected to the first voltage end, the reset transistor configured to, in the reset state, pull down the output end of the output module such that the driving transistor of the pixel driving circuit is turned off; and a first storage capacitor, electrically connected between the pull-down transistor and the second voltage end, configured to maintain gate voltages of the pull-down transistor and the reset transistor.

In the display panel, the pull-down control module comprises: a first transistor, having a gate electrically connected to the scan control module, a first electrode electrically connected to a third voltage end, and a second electrode electrically connected to the gate of the pull-down transistor; the first transistor configured to, in the reset state, enable the pull-down module to work; and a second transistor, having a gate electrically connected to the first electrode of the pull-down transistor, a first electrode electrically connected to the second electrode of the first transistor, and a second electrode electrically connected to the second voltage end; the second transistor configured to, in an input state, an output state and a pull-down state, maintain the pull-down module to be turned off such that the $n^{th}$-stage clock signal is written into the output end of the output module.

In the display panel, the scan control signal comprises a forward scan control signal and a backward scan control signal, and the scan control module comprises: a third transistor, having a gate receiving a start signal or a $(n-2)^{th}$-stage gate driving signal, a first electrode receiving the forward scan control signal, and a second electrode electrically connected to the gate of the second transistor; the third transistor configured to enable, in the input state, the pull-down control module and the output module to work such that the $n^{th}$-stage clock signal is written into the output end of the output module; a fourth transistor, having a gate electrically connected to a $(n+2)^{th}$-stage gate driving signal, a first electrode electrically connected to the second electrode of the third transistor, and a second electrode receiving the backward scan control signal; the third transistor configured to enable, in the reset state, the pull-down control module to control the pull-down module to work; a fifth transistor, having a gate receiving the forward scan control signal, a first electrode receiving the $(n+2)^{th}$-stage clock signal, and a second electrode electrically connected to the gate of the first transistor; and a sixth transistor, having a gate receiving the backward scan control signal, a first electrode receiving the $(n-2)^{th}$-stage clock signal, and a second electrode electrically connected to the second electrode of the fifth transistor.

In the display panel, the output module comprises: a seventh transistor, having a gate receiving the third voltage end, a first electrode electrically connected to the second electrode of the third transistor, and a second electrode; the output transistor, has a gate electrically connected to the second electrode of the seventh transistor, a first electrode receiving the $n^{th}$-stage clock signal, and a second electrode electrically connected to the first electrode of the reset transistor; and a second storage capacitor, electrically connected between the first electrode of the seventh transistor and the second voltage end, configured to maintain the output transistor to be turned on in the input state, the output state, and the pull-down state such that the $n^{th}$-stage clock signal is written into the output end of the output module.

In the display panel, the gate driving circuit further comprises: a black scan module, electrically connected to the pull-down module and the output module, configured to receive a black scan control signal to perform a black scan operation on a display screen at the time when the display panel is being shut down.

In the display panel, the black scan module comprises: a ninth transistor, having a gate receiving the black scan control signal; a first electrode electrically connected to the pull-down module; and a second electrode electrically connected to the second voltage end; a tenth transistor, having a gate, a first electrode electrically connected to the gate of the tenth transistor and the gate of the ninth transistor; and a second electrode electrically connected to the output end of the output module.

In the display panel, the first electrode of the ninth electrode is electrically connected to the gate of the reset transistor in the pull-down module; and the second electrode of the tenth transistor is electrically connected to the second electrode of the output transistor in the output module.

In the display panel, the first voltage end is a direct current low voltage supply, and the second voltage end is a direct current high voltage supply.

In the display panel, the third voltage end is a direct current high voltage supply.

In the display panel, the forward scan control signal is a high voltage level signal and the backward scan control signal is a low voltage level signal.

In the display panel, all transistors of the pixel driving circuit are oxide transistors, and all transistors of the gate driving circuit are Low Temperature Polysilicon (LTPS) transistors.

According to an embodiment of the present invention, a gate driving method for driving the above-mentioned gate driving circuit is disclosed. The gate driving method comprises: in an input state, controlling a scan control signal, electrically connected to a scan control module in the gate driving circuit, to enable an output module and a pull-down control module to work such that the pull-down control module controls pull-down module to be turned off and a $n^{th}$-stage clock signal is written into an output end of the output module; in an output state, the $n^{th}$-stage clock signal makes the output module has a bootstrap effect such that the output end of the output module outputs a gate driving signal and the gate driving signal drives the driving transistor of the pixel driving circuit to work; in a pull-down state, the output module maintains working such that the $n^{th}$-stage clock signal is written into the output end of the output module through a cooperation of the pull-down control module and the $n^{th}$-stage clock signal; and in a reset state, the scan control signal enables the pull-down control module to work, the pull-down control module controls the pull-down module to be in a working state, the second voltage end cuts off the output transistor in the output module, the output end of the output module is electrically connected to the first voltage end, and the driving transistor is turned off.

According to an embodiment of the present invention, a display device comprising the display panel as disclosed above is provided.

Advantageous Effects

In contrast to the conventional art, an embodiment of the present invention provides a display pane, a gate driving method and a display device. The display panel comprises a pixel driving circuit in a display area and a gate driving circuit in a non-display area. The gate driving circuit is electrically connected to a first voltage end and a second voltage end. The first voltage end is configured to turn off a driving transistor of the pixel driving circuit electrically connected to an output end of the gate driving circuit. The second voltage end is configured to turn off an output transistor of the gate driving circuit to suppress the gate voltage shift of the driving transistor in the pixel driving circuit such that the reliability of the driving transistor and the fault tolerance of the display panel could be raised.

BRIEF DESCRIPTION OF THE DRAWINGS

Embodiments of the present application are illustrated in detail in the accompanying drawings, in which like or similar reference numerals refer to like or similar elements or elements having the same or similar functions throughout the specification. The embodiments described below with reference to the accompanying drawings are exemplary and are intended to be illustrative of the present application, and are not to be construed as limiting the scope of the present application.

DETAILED DESCRIPTION OF PREFERRED EMBODIMENTS

For the purpose of description rather than limitation, the following provides such specific details as a specific system structure, interface, and technology for a thorough understanding of the application. However, it is understandable by persons skilled in the art that the application can also be implemented in other embodiments not providing such specific details. In other cases, details of a well-known apparatus, circuit and method are omitted to avoid hindering the description of the application by unnecessary details.

Figure 1:
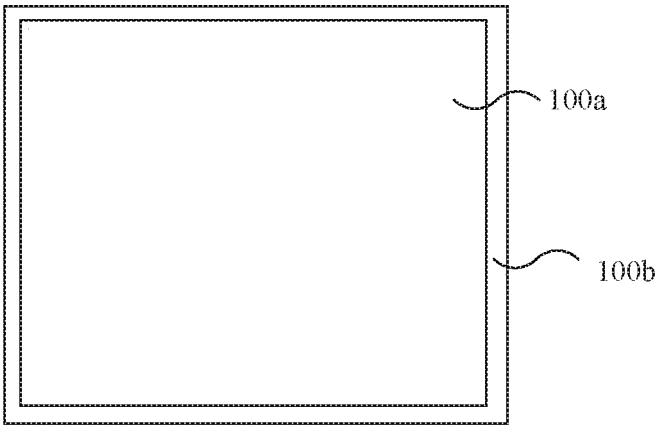
FIG. 1 is a diagram of a display panel according to an embodiment of the present invention.
Figure 2A:
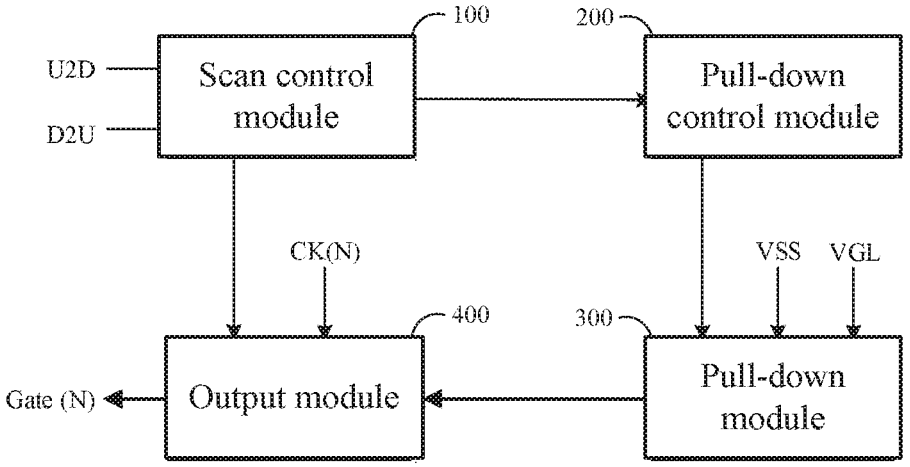
FIG. 2A-FIG. 2B show the operation of the gate driving circuit according to an embodiment of the present invention.
Figure 2B:
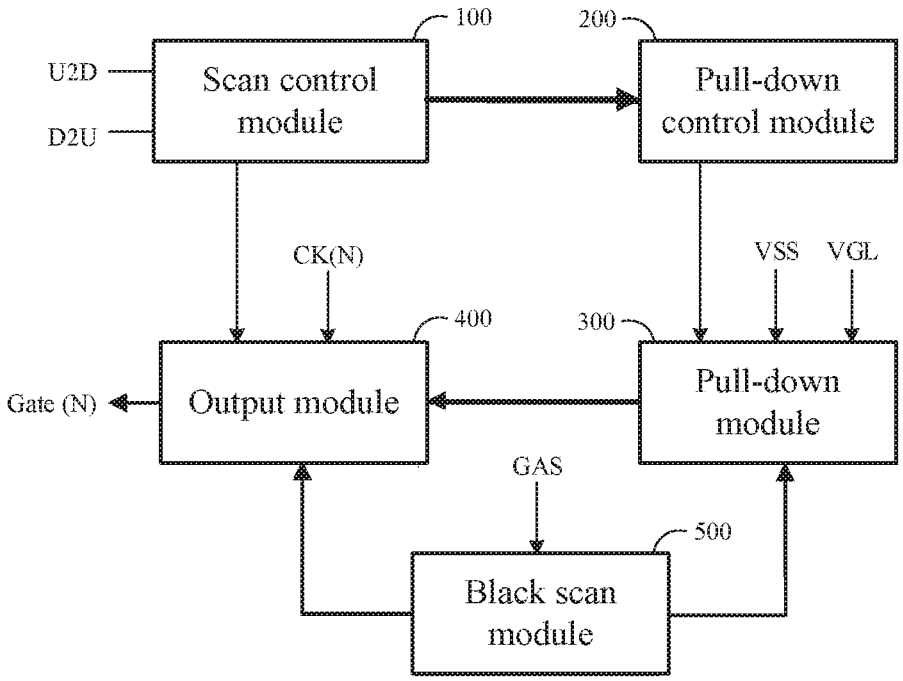
Figure 3A:
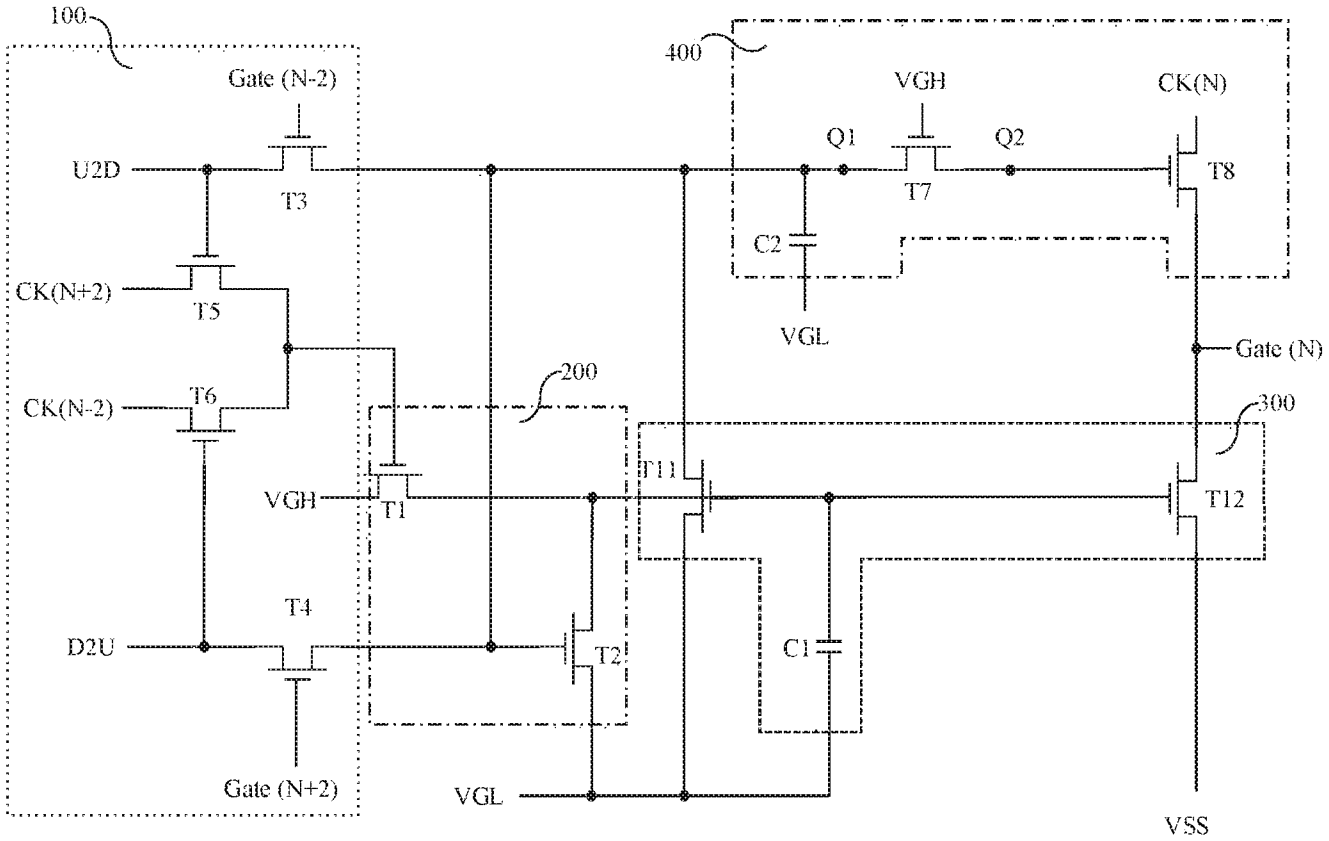
FIG. 3A-FIG. 3B show the structure of the gate driving circuit according to an embodiment of the present invention.
Figure 3B:
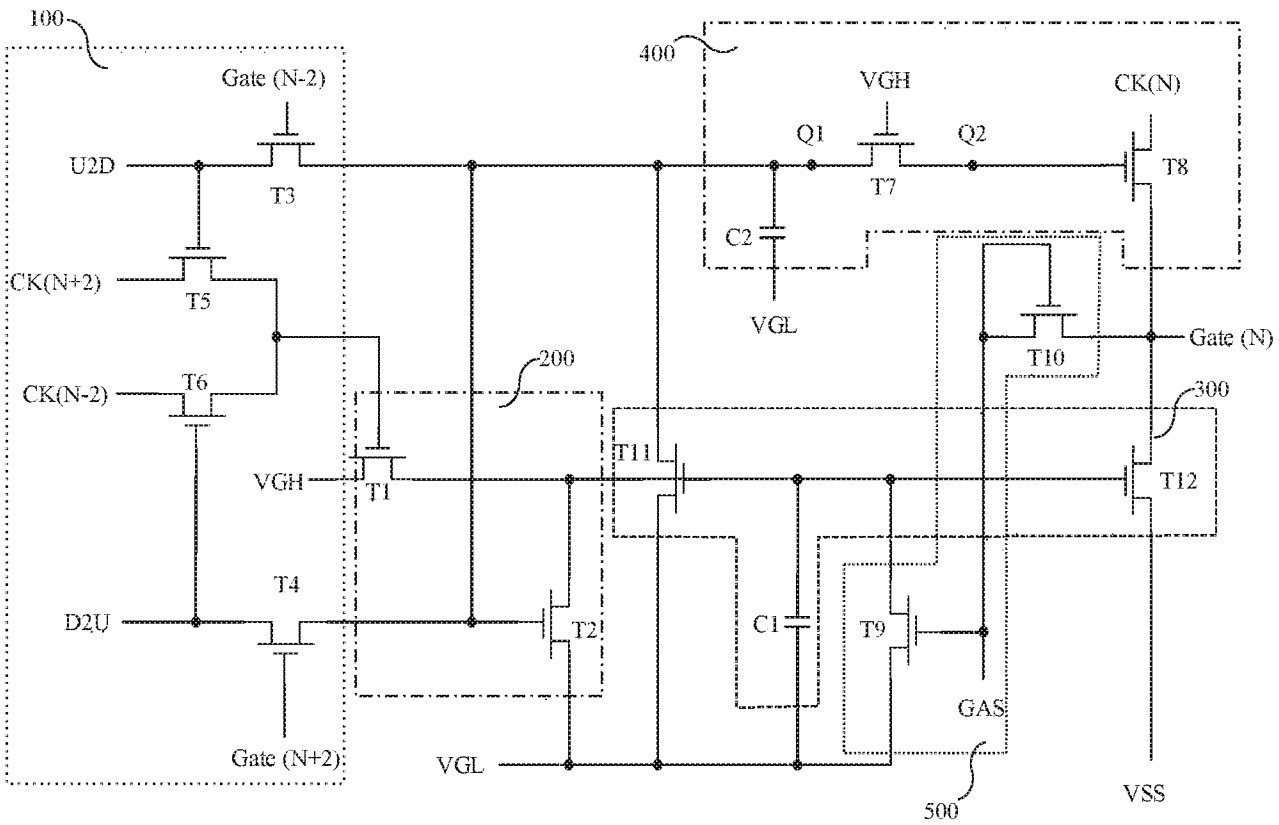
Figure 3C:
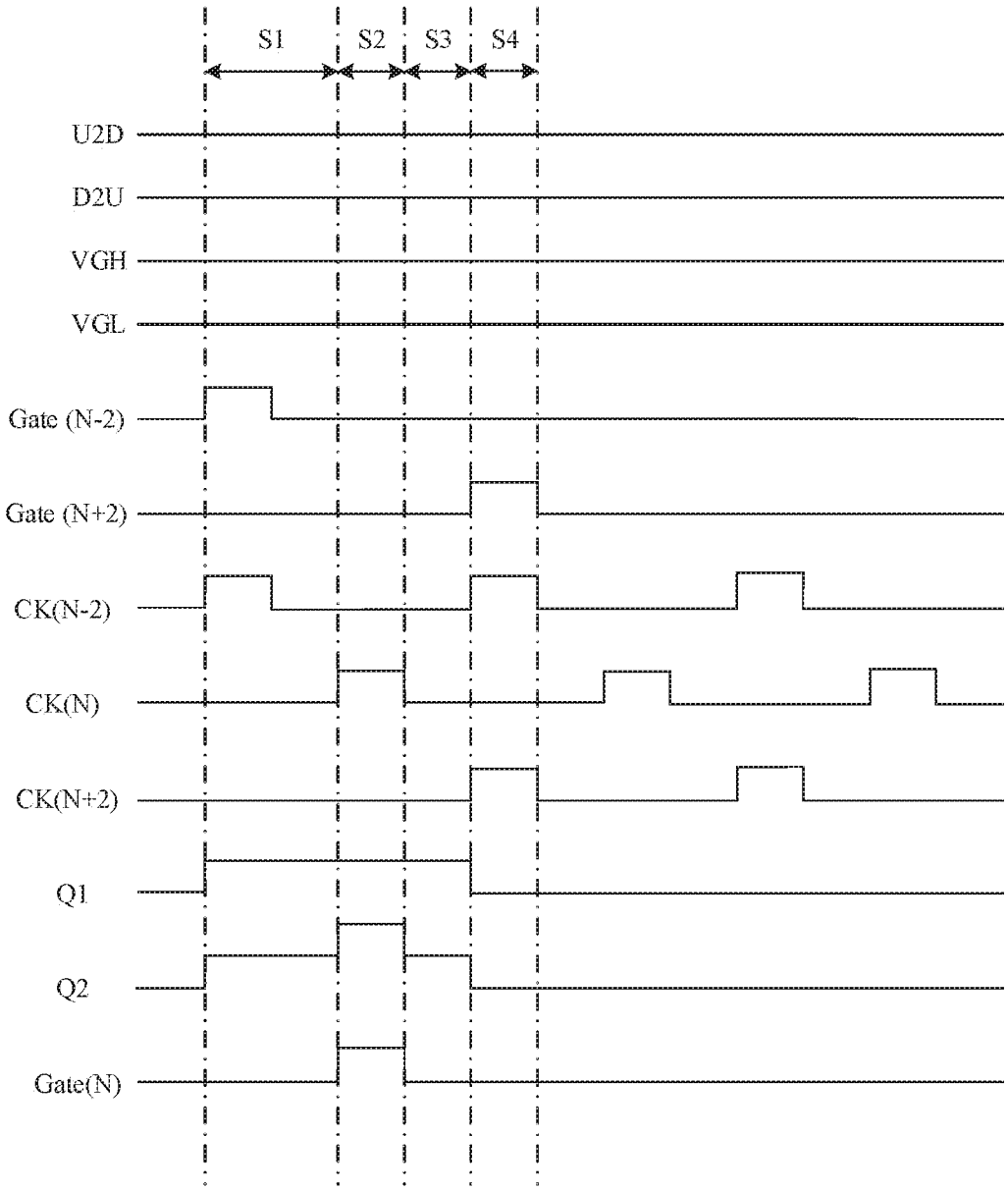
FIG. 3C is a timing diagram of the gate driving circuit according to an embodiment of the present invention.

Please refer to FIG. 1-FIG. 3C. FIG. 1 is a diagram of a display panel according to an embodiment of the present invention. FIG. 2A-FIG. 2B show the operation of the gate driving circuit according to an embodiment of the present invention. FIG. 3A-FIG. 3B show the structure of the gate driving circuit according to an embodiment of the present invention. FIG. 3C is a timing diagram of the gate driving circuit according to an embodiment of the present invention.

The display panel comprises a display area 100*a* and a non-display area 100*b*. The display panel comprises a pixel driving circuit in the display area 100*a* and a gate driving circuit in the non-display area 100*b*. The gate driving circuit is electrically connected to a first voltage end VSS and a second voltage end VGL. The first voltage end VSS is configured to turn off a driving transistor of the pixel driving circuit electrically connected to an output end Gate(N) of the gate driving circuit. The second voltage end VGL is configured to turn off an output transistor T8 of the gate driving circuit to suppress the gate voltage shift of the driving transistor in the pixel driving circuit such that the reliability of the driving transistor and the fault tolerance of the display panel could be raised.

Please refer to FIG. 2A-2B and FIG. 3A-FIG. 3C. The gate driving circuit comprises cascaded stages of sub-circuits, where an $n^{th}$-stage sub-circuit of the sub-circuits comprises: a scan control module 100 and a pull-down control module 200. The scan control module 100 is configured to perform a forward scan or a backward scan according to a scan control signal. The pull-down control module 200 is electrically connected to the scan control module 100 and is configured to control a working state of a pull-down module 300 according to the scan control module.

The pull-down module 300 is electrically connected to the pull-down control module 200 and an output module 400 and is electrically connected to the first voltage end VSS and the second voltage end VGL. The pull-down module 300 is configured to, in a reset state S4, utilize the second voltage end VGL to turn off the output transistor T8 of the output module 400 and connect the first voltage end VSS to an output end Gate(N) of the output module 400 to pull down the output end Gate(N) of the output module 400 such that the driving transistor of the pixel driving circuit is turned off. The output module 400 is electrically connected to the scan control module 100 and the pull-down module 300. The output module 400 receives an $n^{th}$-stage clock signal CK(N) and the output module 400 is configured to output a gate driving signal.

Because the pull-down module 300 is utilized, in the reset state S4, to connect the output end Gate(N) of the output module 400 to the first voltage end VSS to pull down the output end Gate(N) of the output module 400, the gate voltage of the driving transistor in the pixel driving circuit in the display area is adjusted. This suppresses the threshold voltage shift issue caused by biasing the driving transistor for a long time. Thus, the reliability of the driving transistor is raised and further influence on the gate driving circuit is avoided.

In this embodiment, the first voltage end VSS could be modulated through the central control board. The voltage level of the first voltage end VSS could be ensured through a reliability experiment such that a voltage level for turning off the driving transistor could be obtained.

The transistors in the pixel driving circuit in the display area are field effect transistors (FETs). Furthermore, the transistors in the pixel driving circuit in the display area could be thin film transistors (TFTs). In addition, the transistors in the pixel driving circuit in the display area are oxide TFTs.

According to an embodiment of the present invention, a gate driving method for driving the above-mentioned gate driving circuit is disclosed. The gate driving method comprises:

In an input state S1, the scan control signal, electrically connected to a scan control module 100 in the gate driving circuit, enables the output module 400 and the pull-down control module 200 to work such that the pull-down control module 200 maintains the pull-down module 300 to in the "off" state and the $n^{th}$-stage clock signal CK(N) is written into the output end Gate(N) of the output module 400.

In an output state S2, the $n^{th}$-stage clock signal CK(N) makes the output module has a bootstrap effect such that the output end Gate(N) of the output module 400 outputs a gate driving signal and the gate driving signal drives the driving transistor of the pixel driving circuit to work.

In a pull-down state S3, the output module 400 keeps working such that the $n^{th}$-stage clock signal is written into the output end Gate(N) of the output module 400 through a cooperation of the pull-down control module 200 and the $n^{th}$-stage clock signal CK(N).

In a reset state S4, the scan control signal enables the pull-down control module 200 to work. The pull-down control module 200 controls the pull-down module to be in a working state. The second voltage end VGL cuts off the output transistor T8 in the output module 400. The output end Gate(N) of the output module 400 is electrically connected to the first voltage end VSS, and the driving transistor is turned off.

Please continue to refer to FIG. 2A-2B and FIG. 3A-FIG. 3C. The pull-down module 300 comprises a pull-down transistor T11, a reset transistor T12 and a first storage capacitor C1.

The gate of the pull-down transistor T11 is electrically connected to the pull-down control module 200. The first electrode of the pull-down transistor T11 is electrically connected to the output module 400. The second electrode of the pull-down transistor T11 receives the second voltage end VGL. The pull-down transistor T11 is configured to turn off the output transistor T8 in the reset state S4 to stop writing the $n^{th}$-stage clock signal CK(N) into the output end Gate(N) of the output module 400.

The gate of the reset transistor T12 is electrically connected to the gate of the pull-down transistor T11. The first electrode of the reset transistor T12 is electrically connected to the output end Gate(N) of the output module 400. The second electrode of the reset transistor T12 is electrically connected to the first voltage end VSS. The reset transistor T12 is configured to, in the reset state S4, pull down the output end Gate(N) of the output module 400 such that the driving transistor of the pixel driving circuit is turned off.

One end of the first storage capacitor C1 is electrically connected to the gate of the pull-down transistor T11. The other end of the first storage capacitor C1 receives the second voltage end VGL. The first storage capacitor C1 is configured to maintain gate voltages of the pull-down transistor and the reset transistor.

The pull-down control module 200 comprises a first transistor T1 and a second transistor T2.

The gate of the first transistor T1 is electrically connected to the scan control module 100. The first electrode of the first transistor T1 is electrically connected to a third voltage end VGH. The second electrode of the first transistor T1 is electrically connected to the gate of the pull-down transistor T11. The first transistor T1 is configured to, in the reset state S4, enable the pull-down module 300 to work.

The gate of the second transistor T2 is electrically connected to the first electrode of the pull-down transistor T11. The first electrode of the second transistor T2 is electrically connected to the second electrode of the first transistor T1. The second electrode of the second transistor T2 is electrically connected to the second voltage end VGL. The second transistor T2 configured to, in the input state S1, the output state S2 and the pull-down state S3, maintain the pull-down module to be turned off such that the $n^{th}$-stage clock signal is written into the output end Gate(N) of the output module 400.

The scan control signal comprises a forward scan control signal U2D and a backward scan control signal D2U. The scan control module 100 comprises a third transistor T3, a fourth transistor T4, a fifth transistor T5, and a sixth transistor T6.

The gate of the third transistor T3 receives a $(n-2)^{th}$-stage gate driving signal Gate(N−2). The first electrode of the third transistor T3 receives the forward scan control signal U2D. The second electrode of the third transistor T3 is electrically connected to the gate of the second transistor T2. The third transistor T3 is configured to enable, in the input state S1, the pull-down control module 200 and the output module 400 to work such that the $n^{th}$-stage clock signal is written into the output end Gate(N) of the output module 400.

The gate of the fourth transistor T4 is electrically connected to a $(n+2)^{th}$-stage gate driving signal Gate(N+2). The first electrode of the fourth transistor T4 is electrically connected to the second electrode of the third transistor T3. The second electrode of the fourth transistor T4 receives the backward scan control signal D2U. The third transistor T3 is configured to enable, in the reset state S4, the pull-down control module 200 to control the pull-down module 300 to work.

The gate of the fifth transistor T5 receives the forward scan control signal U2D. The first electrode of the fifth transistor T5 receives the $(n+2)^{th}$-stage clock signal CK(N+2). The second electrode of the fifth transistor T5 is electrically connected to the gate of the first transistor T1.

The gate of the sixth transistor T6 receives the backward scan control signal D2U. The first electrode of the sixth transistor T6 receives the $(n-2)^{th}$-stage clock signal CK(N−2). The second electrode of the sixth transistor T6 is electrically connected to the second electrode of the fifth transistor T5.

The output module 400 comprises a seventh transistor T7, the output transistor T8, and a second storage capacitor C2.

The gate of the seventh transistor T7 receives the third voltage end VGH. The first electrode of the seventh transistor T7 is electrically connected to the second electrode of the third transistor T3.

The gate of the output transistor T8 is electrically connected to the second electrode of the seventh transistor T7. The first electrode of the output transistor T8 receives the $n^{th}$-stage clock signal CK(N). The second electrode of the output transistor T8 is electrically connected to the first electrode of the reset transistor T12.

One end of the second storage capacitor C2 is electrically connected to the first electrode of the seventh transistor T7 and the other end of the second storage capacitor C2 is electrically to the second voltage end VGL. The second storage capacitor is configured to maintain the output transistor T8 to be turned on in the input state S1, the output state S2, and the pull-down state S3 such that the $n^{th}$-stage clock signal CK(N) is written into the output end Gate(N) of the output module 400.

In this embodiment, the first voltage end VSS is a DC low voltage source, the second voltage end VGL is a DC low voltage source, and the third voltage end VGL is a DC high voltage source.

The transistors in the gate driving circuit in the display area are field effect transistors (FETs). Furthermore, the transistors in the gate driving circuit in the display area could be thin film transistors (TFTs). In addition, the transistors in the gate driving circuit in the display area are LTPS TFTs. In order to distinguish the source with the drain in a transistor, the first electrode could be regarded as one of the source and the drain and the second electrode could be regarded as the other of the source and the drain.

Please continue to refer to FIG. 3A-FIG. 3C. In this embodiment, the transistors in the gate driving circuit are N-type transistors. The forward scan control signal U2D corresponds to a high voltage level. The backward scan control signal D2D corresponds to a low voltage level. The first voltage end VSS is a DC low voltage source. The second voltage end VGL is a DC low voltage source. The third voltage end VGH is a DC high voltage source. The operation of the gate driving circuit comprises:

In the input state S1:

When the $(n-2)^{th}$-stage gate driving signal Gate(N−2) corresponds to a high voltage level, the third transistor T3 of the scan control module 100 is turned on and the second transistor T2 of the pull-down control module 200 is turned on. At the same time, the seventh transistor T7 in the output module 400 is turned on because the third voltage end VGH is a DC high voltage source. The forward scan control signal U2D is written into the first electrode of the seventh transistor T7 and charges the second storage capacitor C2 such that the forward scan control signal U2D is written into the first electrode and the second electrode (the nodes Q1 and Q2) of the seventh transistor T7. The output transistor T8 is turned on. The $n^{th}$-stage clock signal CK(N) is written into the output end Gate(N) of the output module 400. The second transistor T2 of the pull-down control module 200 is turned on such that the signal from the second voltage end VGL is written into the gates of the pull-down transistor T11 and the reset transistor T12 in the pull-down module 300 and thus the pull-down transistor T11 and the reset transistor T12 are turned off.

When the $(n-2)^{th}$-stage gate driving signal Gate(N−2) corresponds to a low voltage level, the third transistor T3 of the scan control module 100 is turned off. The seventh transistor T7 in the output module 400 remains on because the third voltage end VGH is a DC high voltage source. The voltage levels at the nodes Q1 and Q2 are maintained because of charges stored in the second storage capacitor C2. The output transistor T8 remains on. At the same time, the charges stored in the second storage capacitor C2 could maintain the second transistor T2 in the pull-down control module 200 to be in the "on" state. The $n^{th}$-stage clock signal CK(N) keeps being written into the output end Gate(N) of the output module 400. The signal from the second voltage end VGL keeps being written into the gates of the pull-down transistor T11 and the reset transistor T12 in the pull-down module 300 and thus the pull-down transistor T11 and the reset transistor T12 are turned off.

In the output state S2:

Because the charges stored in the second storage capacitor C2 maintain the voltage levels at the nodes Q1 and Q2, the output transistor T8 remains on. At the same time, the charges stored in the second storage capacitor C2 maintain the voltage levels at the nodes Q1 and Q2 also maintain the second transistor T2 to be in the "on" state. The signal from the second voltage end VGL keeps being written into the gates of the pull-down transistor T11 and the reset transistor T12 in the pull-down module 300 such that the pull-down transistor T11 and the reset transistor T12 are turned off. The output transistor T8 remains on such that the gate of the output transistor T8 has the bootstrap effect when the $n^{th}$-stage clock signal CK(N) corresponds to a high voltage level. In this way, the voltage level at the node Q2 is pulled high to 2*VGH-VGL. The output transistor T8 is sufficiently turned on. The $n^{th}$-stage clock signal CK(N) of a high voltage level is written into the output end Gate(N) of the output module 400 such that a gate driving signal is provided to the driving transistor of the pixel driving circuit in the display area.

In the pull-down state S3:

The $n^{th}$-stage clock signal CK(N) is switched from a high voltage level to a low voltage level. The bootstrap effect at the gate of the output transistor T8 no longer exists. The charges stored in the second storage capacitor C2 keeps maintaining the voltage levels at the nodes Q1 and Q2. The output transistor T8 remains on. The second transistor T2 in the pull-down control module 200 remains on. The pull-down transistor T11 and the reset transistor T12 in the pull-down module 300 remain off. The $n^{th}$-stage clock signal CK(N) of a low voltage level is written into the output end Gate(N) of the output module 400.

In the reset state S4:

When the $(n+2)^{th}$-stage gate driving signal Gate(N+2) corresponds to a high voltage level, the fourth transistor T4 in the scan control module 100 is turned on. At the same time, because the $(n+2)^{th}$-stage clock signal CK(N+2) and the $(n-2)^{th}$-stage clock signal CK(N−2) correspond to a high voltage level and the forward scan control signal U2D corresponds to a high voltage level, the fifth transistor T5 in the scan control module 100 is turned on. The fourth transistor T4 is turned on such that the backward scan control signal D2U corresponding to a low voltage level is written into the gate of the second transistor T2 in the pull-down control module 200 and thus the second transistor T2 is turned off. The fourth transistor T4 is turned on such that the backward scan control signal D2U corresponding to a low voltage level is written into the first electrode of the seventh transistor T7 in the output module 400. The fifth transistor T5 is turned on such that the first transistor T1 in the pull-down control module 200 is turned on. The gates of the pull-down transistor T11 and the reset transistor T12 in the pull-down module 300 receive the third voltage end VGH such that the pull-down transistor T11 and the reset transistor T12 are turned on. The first storage capacitor C1 is charged and maintains the gate voltages of the pull-down transistor T11 and the reset transistor T12. Because the first electrode and the second electrode (the nodes Q1 and Q2) of the seventh transistor T7 in the output module 400 receive the second voltage end VGL, the output transistor T8 is turned off. The reset transistor T12 is turned on such that the output end Gate(N) of the output module 400 is pulled down to the same voltage level of the first voltage end VSS. Therefore, the gate driving signal outputted from the output end Gate(N) of the output module 400 could adjust the gate voltages of the driving transistor in the pixel driving circuit. This could prevent the transistors in the display area from being biased for a long time. Thus, this could suppress the threshold voltage shift and raise the reliability of the driving transistor and other transistors in the pixel driving circuit.

The gate of the third transistor T3 of the scan control module 100 could receive a start signal STV instead of the $(n-2)^{th}$-stage gate driving signal Gate(N−2). When the gate of the third transistor T3 receives the start signal STV, the operation of the third transistor T3 is similar to the above-mentioned third transistor T3 when it receives the $(n-2)^{th}$-stage gate driving signal Gate(N−2). Therefore, further illustrations are omitted here.

Please refer to FIG. 2B and FIG. 3B. The gate driving circuit further comprises a black scan module 500. The black scan module 500 is electrically connected to the pull-down module 300 and the output module 400. The black scan module 500 is configured to receive a black scan control signal GAS to perform a black scan operation on a display screen at the time when the display panel is being shut down.

The black scan module 500 comprises a ninth transistor T9 and a tenth transistor T10. The gate of the ninth transistor T9 receives the black scan control signal GAS. The first electrode of the ninth transistor T9 is electrically connected to the pull-down module 300. The second electrode of the ninth transistor T9 is electrically connected to the second voltage end VGL.

The gate and the first electrode of the tenth transistor T10 are electrically connected to the gate of the ninth transistor T9. The second electrode of the tenth transistor T10 is electrically connected to the output end Gate(N) of the output module 400.

Furthermore, the first electrode of the ninth transistor T9 is electrically connected to the gate of the reset transistor T12 of the pull-down module 300. The second electrode of the tenth transistor T10 is electrically connected to the second electrode of the output transistor T8 of the output module 400.

At the time when the display device is being shut down, the black scan control signal GAS corresponds to a high voltage level, the other input signals (such as the $(n-2)^{th}$-stage clock signal CK(N−2), the forward scan control signal U2D, etc.) correspond to a low voltage level. The ninth transistor T9 and the tenth transistor T10 in the black scan module 500 are turned on. The gate driving signal outputted from the output end Gate(N) of the output module 400 performs a black scan operation on the display panel.

In this embodiment, in the gate driving circuit shown in FIG. 3A-FIG. 3B, the transistors are N-type transistors. However, this is only an example, not a limitation of the present invention. The N-type transistors could be replaced by P-type transistors and the corresponding signals could be replaced by their inverted signals. A person having ordinary skills in the art could understand this implementation and thus further illustration is omitted here.

Figure 4:
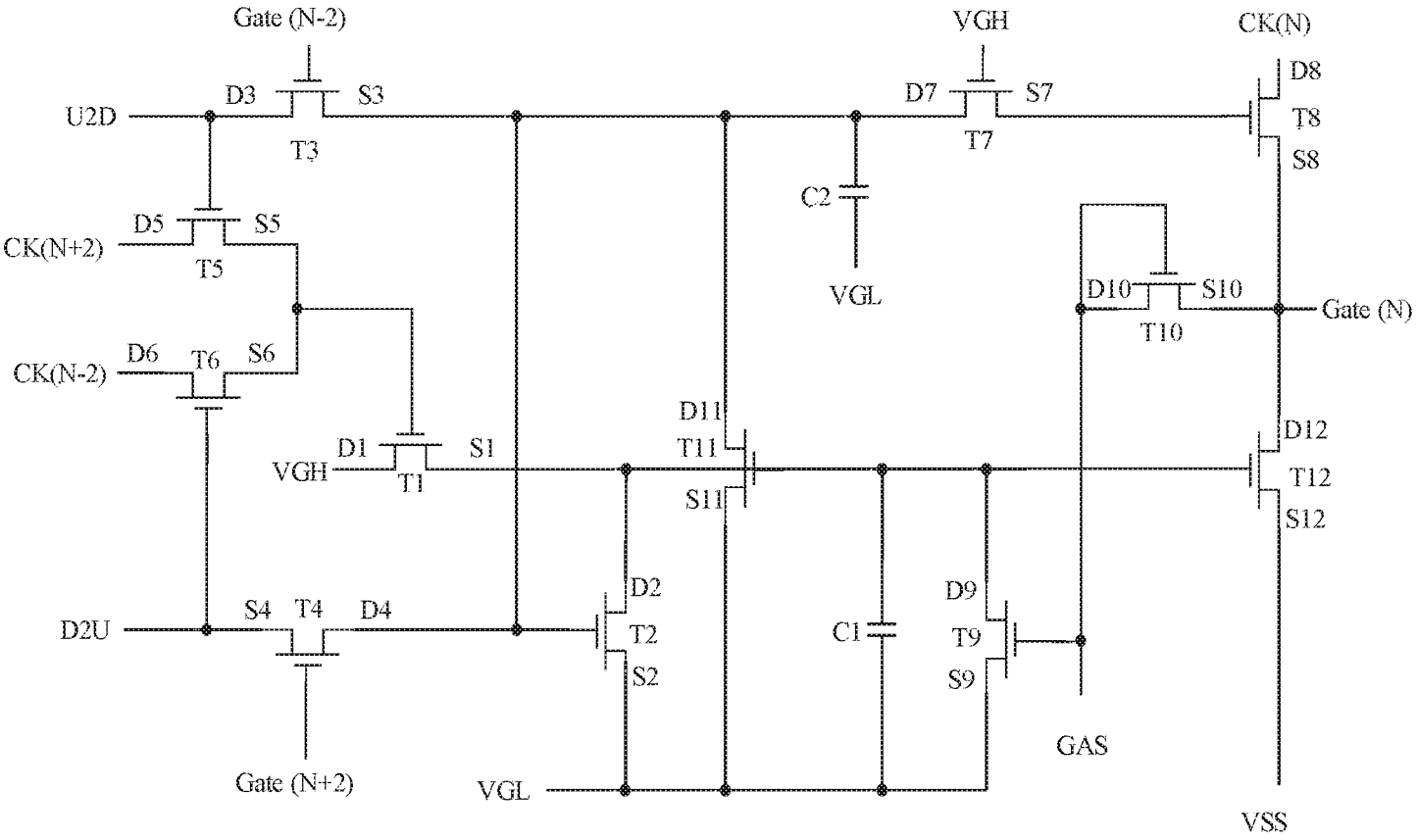
FIG. 4 is a diagram of a gate driving circuit according to an embodiment of the present invention.

Please refer to FIG. 4. FIG. 4 is a diagram of a gate driving circuit according to an embodiment of the present invention. As shown in FIG. 4, a gate driving circuit is disclosed. The gate driving circuit comprises cascaded sub-circuits. The $n^{th}$-stage sub-circuit in the cascaded sub-circuits comprises a first transistor T1, a second transistor T2, a third transistor T3, a fourth transistor T4, a fifth transistor T5, a sixth transistor T6, a seventh transistor T7, an eighth transistor T8, a ninth transistor T9, a tenth transistor T10, an eleventh transistor T11, a twelfth transistor T12, a first storage capacitor C1 and a second storage capacitor C2.

The drain D1 of the first transistor T1 receives the third voltage end VGH.

The drain D2 of the second transistor T2 is electrically connected to the source S1 of the first transistor T1. The source S2 of the second transistor T2 receives the second voltage end VGL.

The gate of the third transistor T3 receives the $(n-2)^{th}$-stage gate driving signal Gate(N−2) or the start signal STV. The drain D3 of the third transistor T3 receives the forward scan control signal U2D. The source S3 of the third transistor T3 is electrically connected to the gate of the second transistor T2.

The gate of the fourth transistor T4 receives the $(n+2)^{th}$-stage gate driving signal Gate(N+2). The drain D4 of the fourth transistor T4 is electrically connected to the source S3 of the third transistor T3. The source S4 of the fourth transistor T4 receives the backward scan control signal D2U.

The gate of the fifth transistor T5 receives the forward scan control signal U2D. The drain D5 of the fifth transistor T5 receives the $(n+2)^{th}$-stage clock signal CK(N+2). The source S5 of the fifth transistor T5 is electrically connected to the gate of the first transistor T1.

The gate of the sixth transistor T6 receives the backward scan control signal D2U. The drain D6 of the sixth transistor T6 receives the $(n-2)^{th}$-stage clock signal CK(N−2). The source S6 of the sixth transistor T6 is electrically connected to the source S5 of the fifth transistor T5.

The gate of the seventh transistor T7 receives the third voltage end VGH. The drain D7 of the seventh transistor T7 is electrically connected to the source S3 of the third transistor T3.

The gate of the eighth transistor T8 is electrically connected to the source S7 of the seventh transistor T7. The drain D8 of the eighth transistor T8 receives the $n^{th}$-stage clock signal CK(N).

The gate of the ninth transistor T9 receives the black scan control signal GAS. The source S9 of the ninth transistor T9 receives the second voltage end VGL.

The gate and the drain D10 of the tenth transistor T10 are electrically connected to the gate of the ninth transistor T9. The source S10 of the tenth transistor T10 is electrically connected to the source S8 of the eighth transistor T8.

The gate of the eleventh transistor T11 is electrically connected to the drain D9 of the ninth transistor T9 and the source S1 of the first transistor T1. The drain D11 of the eleventh transistor T11 is electrically connected to the drain D7 of the seventh transistor T7. The source S11 of the eleventh transistor T11 receives the second voltage end VGL.

The gate of the twelfth transistor T12 is electrically connected to the gate of the eleventh transistor T11. The drain D12 of the twelfth transistor T12 is electrically connected to the source S8 of the eighth transistor T8. The source S12 of the twelfth transistor T12 receives the first voltage end VSS.

One end of the first storage capacitor C1 is electrically connected to the gate of the eleventh transistor T11. The other end of the first storage capacitor C1 receives the second voltage end VGL.

One end of the second storage capacitor C2 is electrically connected to the drain D7 of the seventh transistor T7. The other end of the second storage capacitor C2 receives the second voltage end VGL.

In this embodiment, only the $n^{th}$-stage sub-circuit is illustrated because the other stages of sub-circuits are similar. Thus, further illustrations are omitted here.

According to an embodiment of the present invention, a display device is disclosed. The display device comprises the above-mentioned display panel.

The display device could be a LCD, a flexible display device, etc. Furthermore, the gate driving circuit could be adopted in a high-resolution display device. In addition, the flexible display device comprises light emitting devices. Furthermore, the light emitting devices comprise OLEDs, Mimi LEDs and/or Micro LEDs.

Specifically, the display device could be a mobile display device or a non-movable display device, such as a cell phone, a laptop, a desktop computer, a wristband, a learning machine, etc.

In the display device, the gate driving circuit is utilized to drive the driving transistor in the pixel driving circuit. This could prevent the driving transistor from being biased for a long time and suppress the threshold voltage shift of the driving transistor. This could also raise the reliability of the transistors in the display area. Furthermore, because the first voltage end VSS could be adjusted according to the actual demands, the bias voltages of the transistors in the display area can be adjusted such that the fault tolerance of the display device is raised.

The present invention provides a display panel, a gate driving method and a display device. The display panel comprises a display area 100*a* and a non-display area 100*b*. The display panel comprises a pixel driving circuit in the display area 100*a* and a gate driving circuit in the non-display area 100*b*. The gate driving circuit is electrically connected to the first voltage end VSS and the second voltage end VSS. The first voltage end VSS is used to turn off the driving transistor in the pixel driving signal connected to the output end Gate(N) of the gate driving circuit. The second voltage end VGL is used to turn off the output transistor T8 of the gate driving circuit to suppress the threshold voltage shift of the driving transistor in the pixel driving circuit and raise the reliability of the driving transistor and the fault tolerance of the display panel.

In the above embodiments, each embodiment may have its own focus. Therefore, if one embodiment does not illustrate something in details, one having ordinary skills in the art could refer to another embodiment to understand the disclosure.

Above are embodiments of the present invention, which does not limit the scope of the present invention. Any modifications, equivalent replacements or improvements within the spirit and principles of the embodiment described above should be covered by the protected scope of the invention.

What is claimed is:

1. A display panel, comprising:

a pixel driving circuit in a display area; and a gate driving circuit, electrically connected to a first voltage end and a second voltage end, comprising cascaded stages of sub-circuits in a non-display area;

wherein an $n^{th}$-stage sub-circuit of the sub-circuits comprises:

a scan control module, configured to perform a forward scan or a backward scan according to a scan control signal;

a pull-down module, electrically connected to the first voltage end and the second voltage end; and a pull-down control module, electrically connected to the scan control module, configured to control a working state of the pull-down module; and an output module, electrically connected to the scan control module and the pull-down module, configured to receive an $n^{th}$-stage clock signal and to output a gate driving signal;

wherein the pull-down module comprises:

a pull-down transistor, having a gate electrically connected to the pull-down control module, a first electrode electrically connected to the output module, and a second electrode receiving the second voltage end, the pull-down transistor configured to turn off an output transistor in the reset state to stop writing the $n^{th}$-stage clock signal into an output end of the output module;

a reset transistor, having a gate electrically connected to the gate of the pull-down transistor, a first electrode electrically connected to the output end of the output module, and a second electrode electrically connected to the first voltage end, the reset transistor configured to, in the reset state, pull down the output end of the output module such that a driving transistor of the pixel driving circuit is turned off; and a first storage capacitor, electrically connected between the pull-down transistor and the second voltage end, configured to maintain gate voltages of the pull-down transistor and the reset transistor;

wherein the pull-down module is configured to, in a reset state, utilize the second voltage end to turn off the output transistor of the output module and connect the first voltage end to an output end of the output module to pull down the output end of the output module such that the driving transistor of the pixel driving circuit is turned off;

wherein the pull-down control module comprises:

a first transistor, having a gate electrically connected to the scan control module, a first electrode electrically connected to a third voltage end, and a second electrode electrically connected to the gate of the pull-down transistor; the first transistor configured to, in the reset state, enable the pull-down module to work; and a second transistor, having a gate electrically connected to the first electrode of the pull-down transistor, a first electrode electrically connected to the second electrode of the first transistor, and a second electrode electrically connected to the second voltage end; the second transistor configured to, in an input state, an output state and a pull-down state, maintain the pull-down module to be turned off such that the $n^{th}$-stage clock signal is written into the output end of the output module;

wherein the scan control signal comprises a forward scan control signal and a backward scan control signal, and the scan control module comprises:

a third transistor, having a gate receiving a start signal or a $(n-2)^{th}$-stage gate driving signal, a first electrode receiving the forward scan control signal, and a second electrode electrically connected to the gate of the second transistor; the third transistor configured to enable, in the input state, the pull-down control module and the output module to work such that the $n^{th}$-stage clock signal is written into the output end of the output module;

a fourth transistor, having a gate electrically connected to a $(n+2)^{th}$-stage gate driving signal, a first electrode electrically connected to the second electrode of the third transistor, and a second electrode receiving the backward scan control signal; the third transistor configured to enable, in the reset state, the pull-down control module to control the pull-down module to work;

a fifth transistor, having a gate receiving the forward scan control signal, a first electrode receiving the $(n+2)^{th}$-stage clock signal, and a second electrode electrically connected to the gate of the first transistor; and a sixth transistor, having a gate receiving the backward scan control signal, a first electrode receiving the $(n-2)^{th}$-stage clock signal, and a second electrode electrically connected to the second electrode of the fifth transistor.

2. The display panel of claim 1, wherein the output module comprises:

a seventh transistor, having a gate receiving the third voltage end, a first electrode electrically connected to the second electrode of the third transistor, and a second electrode;

the output transistor, has a gate electrically connected to the second electrode of the seventh transistor, a first electrode receiving the $n^{th}$-stage clock signal, and a second electrode electrically connected to the first electrode of the reset transistor; and a second storage capacitor, electrically connected between the first electrode of the seventh transistor and the second voltage end, configured to maintain the output transistor to be turned on in the input state, the output state, and the pull-down state such that the $n^{th}$-stage clock signal is written into the output end of the output module.

3. The display panel of claim 1, wherein the gate driving circuit further comprises:

a black scan module, electrically connected to the pull-down module and the output module, configured to receive a black scan control signal to perform a black scan operation on a display screen at the time when the display panel is being shut down.

4. The display panel of claim 3, wherein the black scan module comprises:

a ninth transistor, having a gate receiving the black scan control signal; a first electrode electrically connected to the pull-down module; and a second electrode electrically connected to the second voltage end;

a tenth transistor, having a gate, a first electrode electrically connected to the gate of the tenth transistor and the gate of the ninth transistor; and a second electrode electrically connected to the output end of the output module.

5. The display panel of claim 4, wherein the first electrode of the ninth electrode is electrically connected to the gate of the reset transistor in the pull-down module; and the second electrode of the tenth transistor is electrically connected to the second electrode of the output transistor in the output module.

6. The display panel of claim 1, wherein the first voltage end is a direct current low voltage supply, and the second voltage end is a direct current high voltage supply.

7. The display panel of claim 1, wherein the third voltage end is a direct current high voltage supply.

8. The display panel of claim 1, wherein the forward scan control signal is a high voltage level signal and the backward scan control signal is a low voltage level signal.

9. The display panel of claim 1, wherein all transistors of the pixel driving circuit are oxide transistors, and all transistors of the gate driving circuit are Low Temperature Polysilicon (LTPS) transistors.

10. A display device, comprising a display panel, the display panel comprising:

a pixel driving circuit in a display area; and a gate driving circuit, electrically connected to a first voltage end and a second voltage end, comprising cascaded stages of sub-circuits in a non-display area;

wherein an $n^{th}$-stage sub-circuit of the sub-circuits comprises:

a scan control module, configured to perform a forward scan or a backward scan according to a scan control signal;

a pull-down module, electrically connected to the first voltage end and the second voltage end; and a pull-down control module, electrically connected to the scan control module, configured to control a working state of the pull-down module; and an output module, electrically connected to the scan control module and the pull-down module, configured to receive an $n^{th}$-stage clock signal and to output a gate driving signal;

wherein the pull-down module comprises:

a pull-down transistor, having a gate electrically connected to the pull-down control module, a first electrode electrically connected to the output module, and a second electrode receiving the second voltage end, the pull-down transistor configured to turn off an output transistor in the reset state to stop writing the $n^{th}$-stage clock signal into an output end of the output module;

a reset transistor, having a gate electrically connected to the gate of the pull-down transistor, a first electrode electrically connected to the output end of the output module, and a second electrode electrically connected to the first voltage end, the reset transistor configured to, in the reset state, pull down the output end of the output module such that a driving transistor of the pixel driving circuit is turned off; and a first storage capacitor, electrically connected between the pull-down transistor and the second voltage end, configured to maintain gate voltages of the pull-down transistor and the reset transistor;

wherein the pull-down module is configured to, in a reset state, utilize the second voltage end to turn off the output transistor of the output module and connect the first voltage end to an output end of the output module to pull down the output end of the output module such that the driving transistor of the pixel driving circuit is turned off;

wherein the pull-down control module comprises:

a first transistor, having a gate electrically connected to the scan control module, a first electrode electrically connected to a third voltage end, and a second electrode electrically connected to the gate of the pull-down transistor; the first transistor configured to, in the reset state, enable the pull-down module to work; and a second transistor, having a gate electrically connected to the first electrode of the pull-down transistor, a first electrode electrically connected to the second electrode of the first transistor, and a second electrode electrically connected to the second voltage end; the second transistor configured to, in an input state, an output state and a pull-down state, maintain the pull-down module to be turned off such that the $n^{th}$-stage clock signal is written into the output end of the output module;

wherein the scan control signal comprises a forward scan control signal and a backward scan control signal, and the scan control module comprises:

a third transistor, having a gate receiving a start signal or a $(n-2)^{th}$-stage gate driving signal, a first electrode receiving the forward scan control signal, and a second electrode electrically connected to the gate of the second transistor; the third transistor configured to enable, in the input state, the pull-down control module and the output module to work such that the $n^{th}$-stage clock signal is written into the output end of the output module;

a fourth transistor, having a gate electrically connected to a $(n+2)^{th}$-stage gate driving signal, a first electrode electrically connected to the second electrode of the third transistor, and a second electrode receiving the backward scan control signal; the third transistor configured to enable, in the reset state, the pull-down control module to control the pull-down module to work;

a fifth transistor, having a gate receiving the forward scan control signal, a first electrode receiving the $(n+2)^{th}$-stage clock signal, and a second electrode electrically connected to the gate of the first transistor; and a sixth transistor, having a gate receiving the backward scan control signal, a first electrode receiving the $(n-2)^{th}$-stage clock signal, and a second electrode electrically connected to the second electrode of the fifth transistor.

11. The display device of claim 10, wherein the output module comprises:

a seventh transistor, having a gate receiving the third voltage end, a first electrode electrically connected to the second electrode of the third transistor, and a second electrode;

the output transistor, having a gate electrically connected to the second electrode of the seventh transistor, a first electrode receiving the $n^{th}$-stage clock signal, and a second electrode electrically connected to the first electrode of the reset transistor; and a second storage capacitor, electrically connected between the first electrode of the seventh transistor and the second voltage end, configured to maintain the output transistor to be turned on in the input state, the output state, and the pull-down state such that the $n^{th}$-stage clock signal is written into the output end of the output module.

* * * * *